United States Patent [19]

Lorang

[11] 4,103,896

[45] Aug. 1, 1978

[54] GOLF GRIP TRAINING APPARATUS

[76] Inventor: Walter R. Lorang, 2239 W. Maple Rd., Walled Lake, Mich. 48088

[21] Appl. No.: 790,258

[22] Filed: Apr. 25, 1977

[51] Int. Cl.[2] ..... A63B 69/36

[52] U.S. Cl. ..... 273/183 D; 272/68

[58] Field of Search ..... 273/183 B, 183 D, 186 A, 273/194 R, 183 R, 186 R, 26 B; 272/68

[56] References Cited

U.S. PATENT DOCUMENTS

| | | | |
|---|---|---|---|
| 3,106,403 | 10/1963 | Kirkman | 273/186 A |
| 3,226,704 | 12/1965 | Petrash | 273/186 A |
| 3,323,367 | 6/1967 | Searle | 273/183 D |
| 3,380,305 | 4/1968 | Charell | 273/186 A X |
| 3,762,720 | 10/1973 | Jett | 273/183 D |
| 3,897,058 | 7/1975 | Koch | 273/183 D |
| 4,023,812 | 5/1977 | Lorang | 273/183 B X |

*Primary Examiner*—George J. Marlo
*Attorney, Agent, or Firm*—William T. Sevald

[57] ABSTRACT

The golf grip training apparatus gives a signal to the golfer when the grip of his off-target hand interferes with the grip of his target hand in the swing of the club. A force sensitive element is located in the position of at least the middle fingers of the off-target hand. A signal device is controlled by the force sensitive element to emit a signal when the force exerted by the off-target hand exceeds minimal force. The signal advises the golfer that his off-target hand has exerted more than minimal force and thus has interfered with his target hand in the swing of the club. When no signal emits during the swing, the golfer is advised that his off-target hand has not exerted more than minimal force and thus has not interfered with his target hand in the swing of the club.

8 Claims, 15 Drawing Figures

Fig-1
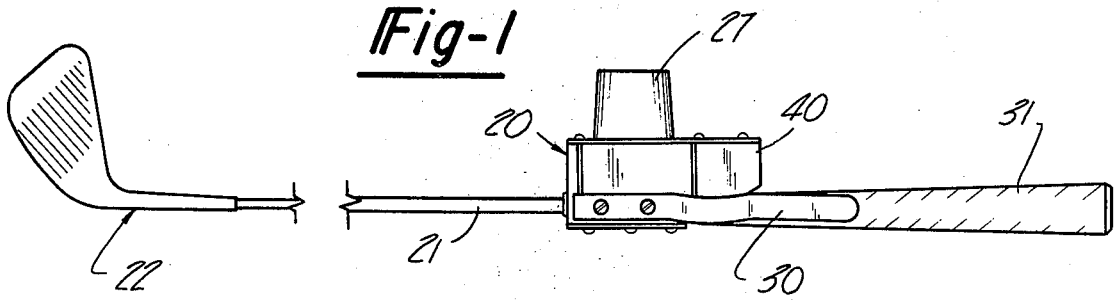
Fig-2
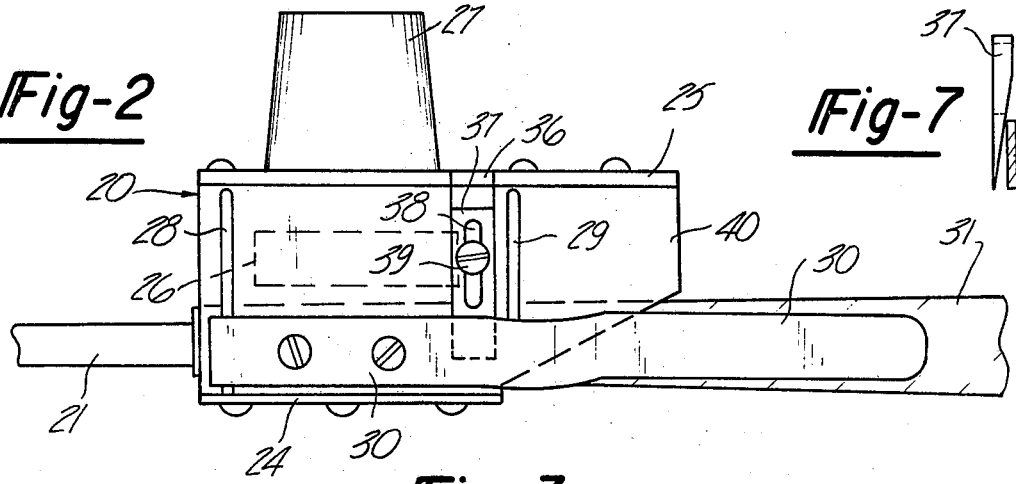
Fig-7
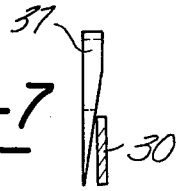
Fig-3
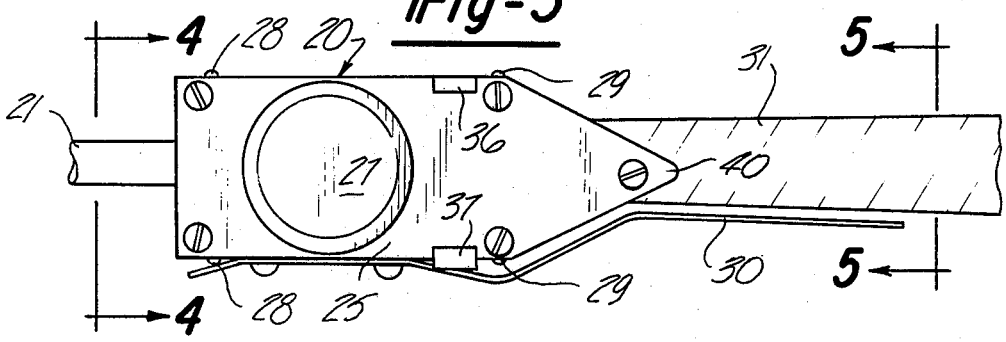
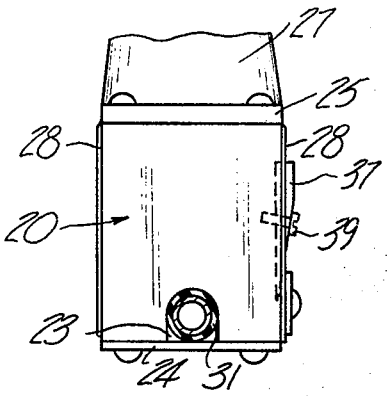
Fig-4
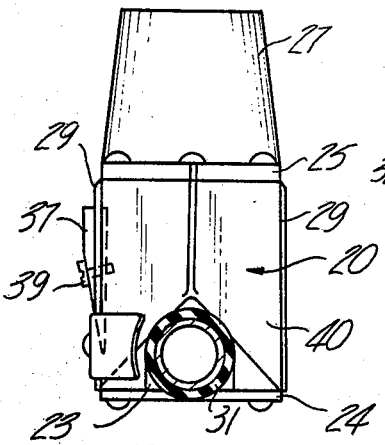
Fig-5
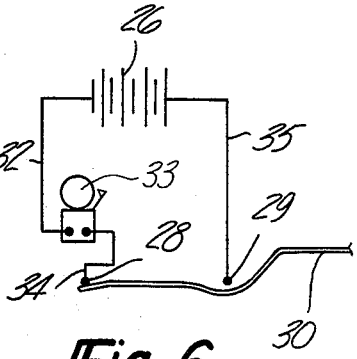
Fig-6

GOLF GRIP TRAINING APPARATUS

BACKGROUND OF THE INVENTION

It is recognized by the experts that low scoring golf ability begins with a good grip and that there are certain things you must do quite precisely and where being approximately right is not enough. The grip is the initial fundamental which must be fully right and where being less than fully right is not enough to give the golfer the foundation on which to build the skill to make a low score. The grip is thus the sine que non of golf.

It is generally recognized by the experts that the target hand should be dominant in the swing and that the off-target hand should not influence the swing. Since the off-target hand of right handed or left handed people is stronger than the target hand and with the person unconsciously pursuing his normally dominant use of the off-target hand with the target hand subservient, it is extremely difficult for the person to reverse the normally dominant hand and render it entirely subservient. Of course the hands work together as a unit in the golf grip and this adds to the person's problems as he has no objective scale of reference to determine whether he has effectively reversed the natural and unconscious dominance of his off-target hand and has correctly made his target hand dominant.

Before summarizing the present invention, the grip which is generally accepted as the "Preferred Grip" should be understood. For a right handed player this grip comprises setting the left hand on the club shaft with the back of the left hand facing the target with the club in the position it would be in in addressing the ball. The club is placed in the left hand so that the shaft is pressed up under the muscular pad at the inside heel of the left palm and so that the shaft lies directly across the top joint of the forefinger with the forefinger crooked around the shaft. The left hand is then closed by closing the last three fingers first and then closing the forefinger and the thumb. In the completed grip of the left hand, the main holding force is in the last three fingers with the last three fingers pressing up and the pad at the heel pressing down with the shaft locked in between. The gripping force of the left hand is thus applied between the last three fingers and the pad. The thumb rests on the top of the shaft and the forefinger lies crooked under the shaft. Thus the thumb and forefinger are loosely applied around the shaft leaving the last three fingers and the pad applying the gripping force. The right hand is then held somewhat extended with the palm facing the target. The right hand is then applied to the club so that the shaft lies across the first joint of the four fingers with the right palm entirely out of contact with the shaft. The right hand grips only with the two middle fingers; the little finger is nested between the middle finger and the forefinger of the left hand. The thumb lies on the left side of the shaft so that the "V" between the thumb and forefinger of the right hand is center-up on the shaft. The forefinger is loosely crooked at the middle joint against the shaft with the tip below and spaced from the thumb. The tips of the right forefinger and thumb touch one another.

In swinging the club with this grip, the super-dominant force is exerted by the last three fingers and pad of the left hand and the only portion of the right hand exerting any minimal force is the two middle fingers and this latter force should be very minimal.

On the back-swing, the left arm with shoulder rotation should push the shaft up with the last three fingers of the left hand supporting the club almost entirely if not entirely. The right arm and hand should not pull the club up and the two middle fingers should only be very slightly pressing to hold the right hand with the left in a completed grip. The key here is how much the right arm and hand interfere with the left by the right hand squeezing and pulling on the shaft. The proper grip is against the grain of the natural unconscious tendency to right hand dominance and pros and amateurs alike have the problem of too much right hand and just about any perceptible right hand is too much.

The foregoing description relative to right-handed players is the reverse for the left handed players.

The prior art is devoid of any means to measure and signal when too much off-target hand influence is involved in the swing.

SUMMARY OF THE PRESENT INVENTION

Since the thumb, forefinger and small finger of the right hand are not in a position of advantage to effect influence on the grip, and since the middle two fingers are in a position of advantage to effect initial right hand influence on the grip and to exert the most force of right hand interference on the grip, it appears that if the two middle fingers are properly used to exert only minimal force on the grip, then the thumb and other fingers initially will not exert perceptible grip force since the two middle fingers must first forcibly contract before the other digits contract to exert force. Thus if the force exerted by the two middle fingers can be maintained at minimum, right hand interference can be reduced in the grip.

To this end, the present invention provides apparatus to measure the force applied to the shaft by at least the two middle fingers of the right hand and to give a warning signal when the force exerted by the fingers has exceeded acceptable minimal force.

In one embodiment of the invention, a case containing a battery, a normally open circuit, a signal means such as a lamp, buzzer or a bell, and a switch arm is mounted on the shaft below the normal position of the hands. The switch arm extends along the left side of the shaft so as to lie under the two middle fingers of the right hand when they are in position on the shaft. The arm is adapted to engage an electrical contact point if the force of the grip of the two middle fingers exceeds minimal acceptable force so as to flex the arm into closing the circuit and activating the warning lamp, buzzer or bell which signals the golfer that he is pressing too hard with the two middle fingers of his right hand and thus is allowing right hand interference.

The case has a pointed nose extending along the center of the shaft toward the golfer. This positions the right hand correctly on the club when the V formed by the thumb and forefinger of the right hand is centered on the point of the nose. The nose may be removable so that the hands can be positioned lower on the club when used in practicing putting.

If the golfer exerts too much right hand on the back-swing by pulling the shaft up with his right arm and hand instead of letting the left arm and hand push the shaft up, the arm is flexed and closes on the contact and the signal is sounded. If the golfer exerted too much right hand on the down-swing by pushing the shaft down with the right arm and hand instead of pulling it down dominantly with the left arm and hand, the arm is flexed and closes on the contact and the signal is sounded.

While the electrical embodiments have been described as exemplary, the description applies equally to the mechanical embodiments.

Thus the apparatus of the invention measures the force of the right hand interference and emits a signal when tolerable force is exceeded to advise the golfer that his right hand is intolerably interfering with the proper left hand dominance of his grip on the backswing and on the force-swing.

The foregoing description relative to right handed players is reversed for left handed players.

The apparatus is easily and quickly mountable on any club as will be understood from the detailed description of the illustrated embodiments taken in connection with the accompanying drawings now described.

DESCRIPTION OF THE DRAWINGS

FIG. 1 is a side elevational view of a golf club with an embodiment of the apparatus of the invention mounted thereon at the bottom end of the grip portion of the shaft with the club foreshortened.

FIG. 2 is an enlarged side elevational view of the apparatus as seen in FIG. 1 with the shaft broken away at both ends and showing a wedge for adjusting the flexing of the arm.

FIG. 3 is a top plan view of the apparatus as seen in FIG. 2.

FIG. 4 is a lower or ground end elevational view of the apparatus as seen in FIG. 3 with the shaft shown in cross-section taken on the line 4—4 of FIG. 3.

FIG. 5 is an upper or golfer end elevational view of the apparatus seen in FIG. 3 with the shaft shown in cross-section taken on a line 5—5 of FIG. 3.

FIG. 6 is a schematic showing of the electrical circuit of the warning signal including a bell.

FIG. 7 is a side elevational view of the adjusting wedge seen in FIGS. 2–5.

DETAILED DESCRIPTION OF THE ILLUSTRATED EMBODIMENTS

Figure 8:
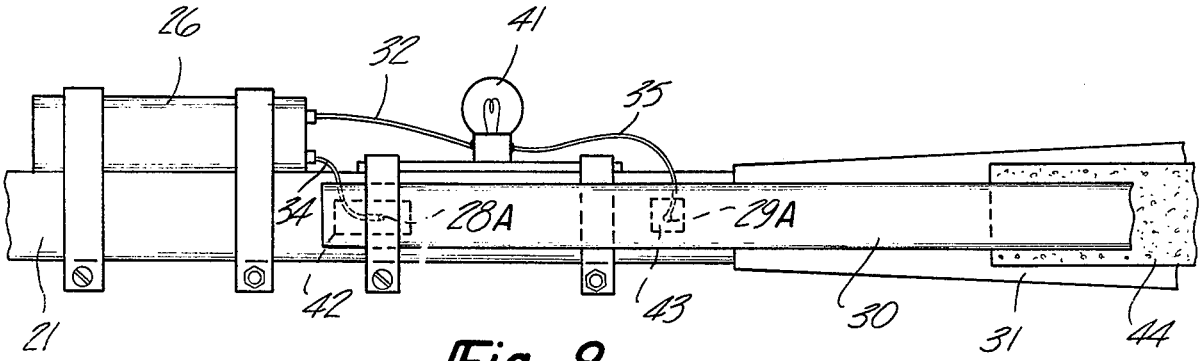
FIG. 8 is a side elevational view of an embodiment of the invention showing a battery and a signal lamp clamped on the shaft, a switch arm secured under one of the clamps, and a resilient member lying beneath the switch arm to regulate deforming force on the switch arm, with the shaft broken away.

Referring now to the drawings wherein like reference numerals refer to like and corresponding parts throughout the several views, the novel Golf-Grip Training Apparatus disclosed therein to illustrate exemplary embodiments of the invention, comprise a case 20 mounted on the shaft 21 of the golf club 22, FIGS. 1–5 and 11. A channel 23 is formed in the case 20 and houses the shaft 21. A base plate 24 is screwed on the bottom of the case 20 over the channel 23 and secures the case 20 on the shaft 21. A cover plate 25 is screwed on the top of the case 20. A battery 26 is contained in the case 20. An electrical buzzer 27 is mounted on the cover plate 25. A U-shaped electrical terminal 28 and a U-shaped electrical terminal 29 lie under the cover plate and extend down both outer sides of the case 20. A switch arm 30 is screwed to the case 20 with its case-end in contact with the terminal 28. The switch arm 30 extends over the terminal 29 in normal spaced relation thereto. The switch arm 30 extends along the target side of the shaft grip portion 31 into the off-target hand position.

A wire 32 connects the battery 26 to the buzzer 27, bell 33, FIG. 6, or lamp 41, FIG. 8. A wire 34 connects the bell 33, lamp 41 or buzzer 27 to the terminal 28 which is connected to the switch arm 30. A wire 35 connects the battery 26 to the terminal 29 which is open and normally spaced from the switch arm 30. Upon the switch arm 30 flexing to contact with the terminal 29 under too much right hand force, FIGS. 1–5, or under too much left hand force, FIG. 11, the circuit is closed and the buzzer 27, lamp 41, or bell 33 produces a signal to the golfer of the incorrect condition.

Recesses 36 are formed in the case 20. An adjusting wedge 37 lies in a recess 36 under the switch arm 30. The wedge 37 has an elongated slot 38. A screw 39 secures the wedge 37 to the case 20. The wedge 37 is made of resilient material so as to be compressible by the switch arm 30. The wedge 37 is adjustable relative to the switch arm 30 via the slot 38 and screw 39.

A pointed inverted "V" shaped wedge 40 may be carried by the case 20 or separately mounted on the shaft. The inverted "V" shaped wedge 40 points toward the golfer along the center line of the shaft 21 with the club 22 in the address position. When the golfer centers the V formed between his right thumb and forefinger on the nose 40, his right hand is correctly aligned, FIGS. 14 and 15.

Referring now to FIG. 8, the battery 26 is clamped on the shaft 21. A signal lamp 41 is clamped on the shaft 21 adjacent the battery 26. Insulator pads 42 and 43 are bonded on the shaft 21. Terminals 28A and 29A lie on the pads 42 and 43 respectively. The pads 42 and 43 insulate the terminals 28A and 29A from the metal of the shaft 21 eliminating short circuiting. The switch arm 30 lies in contact with the terminal 28A and in spaced relation to the terminal 29A. The circuit is as shown in FIG. 6. Upon too much force being exerted on the switch arm 30 by the off-target hand, the switch arm 30 flexes into contact with the terminal 29A closing the circuit and the lamp 41 is lit giving the signal of the incorrect condition.

A resilient pad 44 lies between the switch arm 30 and the grip portion 31 of the club 22, FIG. 8. The durometer of the pad 44 and its size or area of contact with the switch arm 30 provides added mechanical means to measure the force required to move the switch arm 30 into contact with the terminal 29A.

Figure 9:
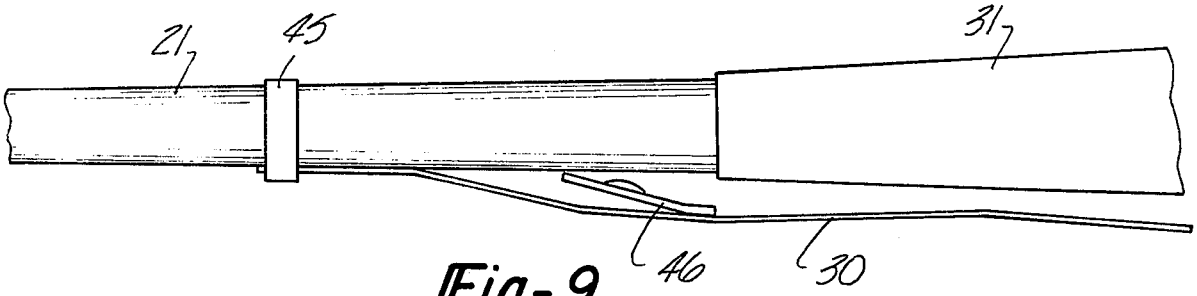
FIG. 9 is a top plan view of an embodiment of the apparatus showing the arm clamped to the shaft and a mechanical "cricket" clicker signal device attached to the arm and abutting the shaft.

Referring now to FIG. 9, an arm 30A is affixed to the shaft 21 by a clamp 45. A mechanical "cricket" clicker 46 is attached to the arm 30A and bears against the shaft 21. Upon the golfers off-target hand gripping the arm 30A with minimal force only to flex arm 30A against the shaft grip portion 31 without further flexing the arm 30A, the clicker 46 is not bent to emit a "click" signal. Upon further force in excess of minimal being exerted on the arm 30A it flexes farther and bends the clicker 46 farther and a "click" signal is emitted advising the golfer that he has exerted too much off-target hand influence in his swing.

Figure 10:
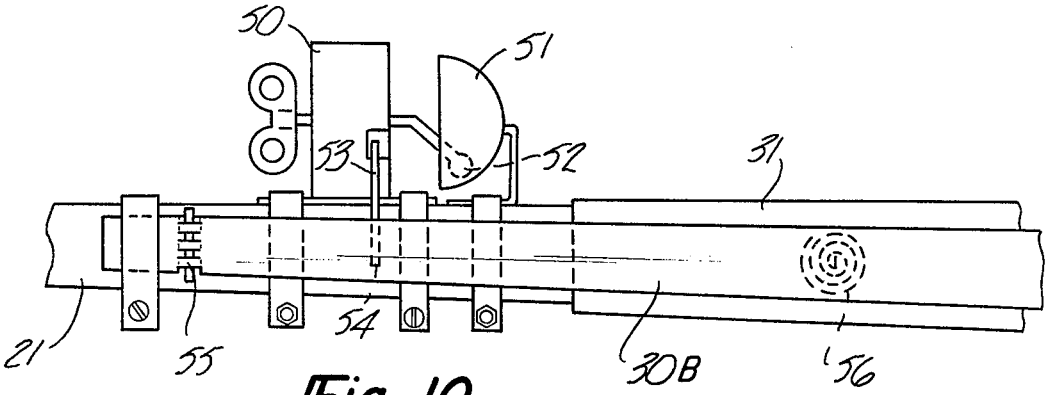
FIG. 10 is a side elevational view of an embodiment of the invention showing a spring wound clock motor, a bell sounded when the clapper is rotated by the motor, a motor release leg under the arm, and a coil spring under the arm to regulate force on the arm, with the shaft broken away.

Referring now to FIG. 10, a key-wound spring clock motor 50 and a bell 51 are clamped to the shaft 21. A clapper 52 in the bell 51 is rotated by the motor 50 to sound the signal. A leg 53 is pivotally mounted on the motor 50 and has an inner end, not shown, normally obstructing the operation of the motor 50. The leg 53 has an outer end 54 lying under the arm 30B. The arm 30B is hingedly connected at 55 to the shaft 21. A coil spring 56 lies between the switch arm 30B and the grip portion 31 of the club 22. Upon the off-target hand flexing the arm 30B with too much force, the arm 30B pivots against and swings the leg 53 and the leg 53 releases the motor 50 to rotate the clapper 52 against the bell 51 to produce a signal that the incorrect condition exists.

Figure 11:
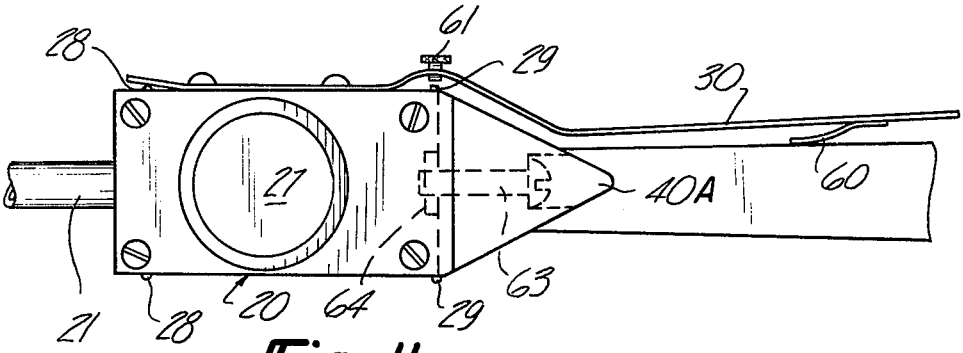
FIG. 11 is a view similar to FIG. 3 showing the apparatus adapted for use by a left-handed golfer, showing the shaft broken away, showing a leaf spring on the switch arm to regulate force on the switch arm, and showing a removable pointed nose.

For the left handed golfer, FIG. 11, the switch arm 30 is located on the right side of the club which, of course, is the target side for left handers. It is to be noted that a leaf or torsion spring 60 is connected to the switch arm 30 and bears against the club portion 31. The spring 60, like the coil spring 56, and the resilient pad 44, provides a compressible medium under the switch arm 30 spaced from its mounting on the other side of the normally open terminal 29, 29A. This provides a steadying effect and produces an added mechanical advantage in maintaining the adjustment of the gap between the normally open terminal 29, 29A and the switch arm 30. This permits repeated heavy use, such as by a teaching professional, to continue over long periods without requiring adjustment of the spacing of the gap and also provides facility of gap adjustment in manufacture and forestalls the difficulties in shipping. The set screw 61, FIG. 11, is threaded in the switch arm 30. The set screw 61 closes against the terminal 29 to close the signal circuit. The spacing between the arm 30 and the terminal 29 is thus adjustable via the set screw 61 to close the circuit. The nose 40A, FIG. 11, is attached by a bolt 63 and a nut 64 bonded to the interior of the case 20. The nose 40A is thus removable by unscrewing the bolt 63. Removing the nose 40A allows the golfer to use the embodiment having the case 20 so that it can be used in putting as the golfer can now move his hands down the shaft to a point closer to the end of the grip portion 31.

Figure 12:
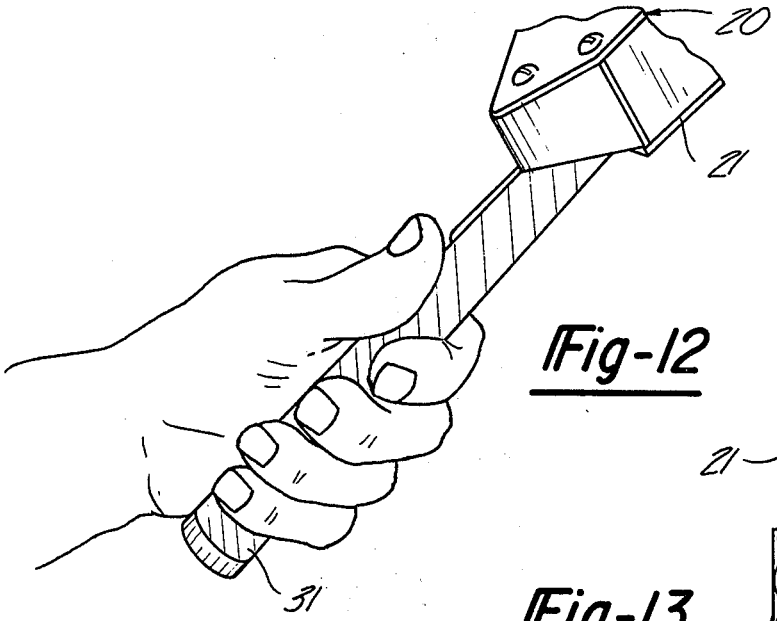
FIG. 12 is an off-target perspective view showing the left hand of a right handed golfer with the left hand gripping the shaft with the apparatus mounted on the shaft, and with the shaft foreshortened.

In the use and operation of the apparatus of the invention by a right handed person, FIG. 12, the golfer grasps the upper end of the shaft with his left hand, with his forefinger crooked loosely under the shaft, with the shaft pressed up against the pad on the heel of his hand, with his next three fingers gripping the shaft, and with his thumb on top of the shaft. It is to be noted that the left hand is spaced from the case 20 and inverted "V" shaped wedge 40 and that the switch arm 30 is not engaged by the left hand.

Figure 13:
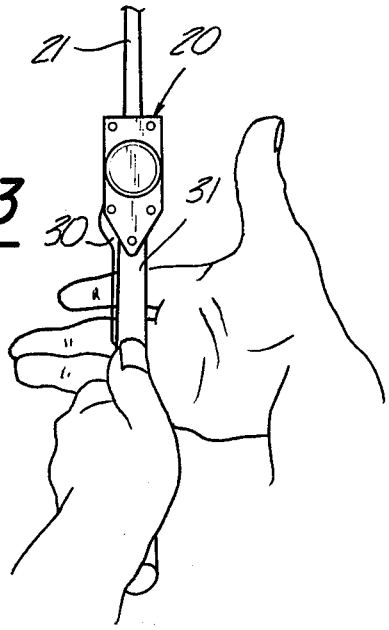
FIG. 13 is a reduced top perspective view of the left hand gripping the shaft as shown in FIG. 12, showing the right hand in the act of being applied to the shaft, with the shaft foreshortened, and showing the switch arm lying along the left side of the shaft.

The golfer, FIG. 13, then applies his right hand to the shaft grip portion 31 entirely free of the right palm with the shaft lying across the first joint of the two middle fingers.

Figure 14:
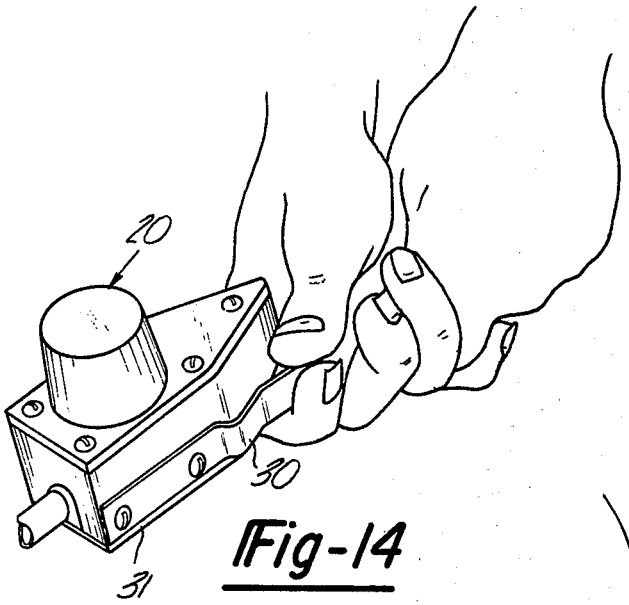
FIG. 14 is a perspective view taken from the target side showing both hands applied to the shaft with the apparatus mounted on the shaft, with the inverted "V" shaped wedge of the apparatus lying in the V formed by the right thumb and forefinger, with the switch lever lying beneath the fingers of the right hand, and showing the shaft foreshortened.
Figure 15:
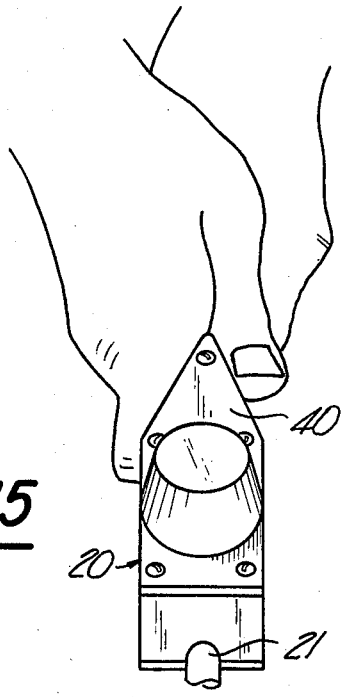
FIG. 15 is a top-front perspective view of the showing of FIG. 14.

He then, FIGS. 14 and 15, closes his two middle fingers of his right hand on the shaft portion 31, overlaps his little finger in the crack between the little and ring finger of his left hand, crooks his right index finger loosely around the club grip portion 31, and loosely engages the tip of his right thumb with the tip of his right index finger. It is to be noted that the V formed by thumb and index finger of the right hand is centered on the point of the inverted "V" shaped wedge 40. It is also to be noted that the switch arm 30 lies under and in contact with the two middle fingers of the right hand.

Having gripped the club as described above, the right handed golfer takes his back swing. If he pushes the club up with his left arm without interference from his right hand, the two middle fingers of the right hand do not compress the switch arm 30 to flex it into contact with terminal 29 and no signal emits. The lack of the signal advises him that his back swing was correct. If he uses too much right hand on his back swing, his two middle fingers compress the switch arm 30 and flex it into contact with the terminal 29 closing the circuit and a buzzer, bell or lamp is activated signaling that the condition of right hand interference exists and that his back swing was not correct.

On the down-swing, if the righthanded golfer properly pulls the club down with his left arm without pushing from his right hand, the middle fingers of the right hand do not compress the switch arm 30 and no signal emits. The lack of the signal advises him that his down swing was correct. If the golfer uses his right hand to push the club down, his two middle fingers of his right hand exert grip force on the switch arm 30 and compress it into contact with the terminal 29 closing the circuit whereupon buzzing or ringing emits or a lamp is lit signaling that the right hand has interfered on the down swing. He is thus advised that his down swing was not correct.

While the embodiment of FIGS. 1–5 and 11 is shown as exemplary in FIGS. 11–14, the use and operation of the other embodiments shown in FIGS. 8 to 10 are the same as above described. The resilient pad 44 seen in FIG. 8, the torsion spring of FIG. 11, and the coil spring 56 and hinge 55 mounting of the switch arm 30B, FIG. 10, may be used singly or in any combination as desired as well as equivalents in practicing the invention.

While various elements have been shown and described, it is to be understood that other equivalents may be utilized to practice the invention and that the claims define the protective scope of the invention. It is to be noted also that while the embodiments of FIGS. 8, 9 and 10 are shown for use by a right handed golfer that they are reversable for use by a left-handed golfer the same as shown in FIG. 11.

I claim:

1. Golf-grip training apparatus in combination with a golf club having a shaft, a hand-grip portion on said shaft, a head on said shaft, and a striking face on said head;

said striking face defining the target side of said shaft, said head, said hand-grip portion, and said striking face;

said apparatus comprising signal means, and force sensitive means connected to said signal means to cause said signal means to emit a signal upon more than minimal force being imposed on said force sensitive means;

said signal means being mounted on said shaft of said golf club and said force sensitive means being mounted on said target side of said hand grip portion of said golf club;

said force sensitive means being positioned on the target side of said hand-grip portion of said golf club when held in the address position so as to be in alignment with said striking face relative to the target;

said force sensitive means overlying said hand-grip portion of said golf club in the location of at least the tip joints of at least the middle two fingers of the golfer's off-target hand;

force in excess of minimal exerted by the fingers of the off-target hand on said force sensitive means in the golfer's grip on and in his swing of a golf club causing said force sensitive means to activate said signal means to emit a signal advising the golfer that his off-target hand has interfered with his swing;

minimal force exerted by the fingers of the off-target hand on said force sensitive means in the grip and in the swing of a golf club not causing said force sensitive means to activate said signal means and the absence of a signal advising the golfer that his off-target hand has not interfered with his swing.

2. In apparatus as set forth in claim 1, said signal means being a mechanical clicker device and said force sensitive means being an arm connected to operate said clicker device to emit a signal upon more than minimal force being imposed on said arm.

3. In apparatus as set forth in claim 1, said signal means comprising a spring motor, a signal device driven by said motor to emit a signal, and a leg normally blocking operation of said motor and movable to a position releasing said motor to operate;

said force sensitive means including an arm in contact with said leg;

more than minimal force imposed on said arm moving said arm to move said leg to release said motor to drive said signal means to emit a signal.

4. In apparatus as set forth in claim 1, said signal means comprising a battery, an electrically powered signal device, and a normally open circuit; and said force sensitive means comprising a normally open switch arm in said circuit adapted to close said circuit upon more than minimal force being imposed on said switch arm to cause said signal device to emit a signal.

5. In Apparatus as set forth in claim 4, a case housing said battery and supporting said circuit, said signal device, and said switch arm;

said case being mounted on said shaft of said golf club.

6. In apparatus as set forth in claim 5, an inverted "V" shaped wedge portion on said case facing the golfer's hands when on said hand grip portion of said golf club;

said wedge lying over the center line of said golf club shaft and point-wise extending toward the top of said golf club to a point on said hand grip portion of said golf club between the thumb and forefinger of the off-target hand of a golfer;

said inverted "V" shaped wedge portion being complimentary to the "V" formed by the thumb and forefinger of the golfer's off-target hand when properly gripping said hand grip portion;

said wedge properly aligning the golfers off-target hand on said golf club hand grip portion when the "V" formed by the thumb and forefinger of the off-target hand fits on said inverted "V" shaped wedge.

7. In apparatus as set forth in claim 1, auxiliary resilient means on said force sensitive means abuttable against the shaft of a club to aid in adjustment of said force sensitive means relative to minimal force and excess of minimal force.

8. In apparatus as set forth in claim 1, adjustable means on said force sensitive means to aid in facilitating the adjustment of said force sensitive means relative to minimal force and excess of minimal force.

* * * * *